US008037583B2

(12) United States Patent
Davis

(10) Patent No.: US 8,037,583 B2
(45) Date of Patent: Oct. 18, 2011

(54) SYSTEMS AND METHODS FOR FABRICATING BIASED FABRIC

(75) Inventor: Gayron Nixon Davis, Opelika, AL (US)

(73) Assignee: Johnston Textiles, Inc., Valley, AL (US)

( * ) Notice: Subject to any disclaimer, the term of this patent is extended or adjusted under 35 U.S.C. 154(b) by 216 days.

(21) Appl. No.: 12/106,737

(22) Filed: Apr. 21, 2008

(65) Prior Publication Data

US 2009/0260747 A1 Oct. 22, 2009

(51) Int. Cl.
*D06C 3/00* (2006.01)

(52) U.S. Cl. ..... 26/51; 8/115.6; 26/51.3

(58) Field of Classification Search ..... 8/115.6; 26/51.3, 51
See application file for complete search history.

(56) References Cited

U.S. PATENT DOCUMENTS 2,711,627 A * 6/1955 Leath et al. ..... 57/282
2,766,503 A * 10/1956 Dungler ..... 26/72
2,823,093 A * 2/1958 Steiger ..... 8/115.6
5,068,000 A * 11/1991 Lauderdale ..... 156/148

* cited by examiner

*Primary Examiner* — Amina Khan
(74) *Attorney, Agent, or Firm* — Thomas, Kayden, Horstemeyer & Risley, LLP

(57) ABSTRACT

In one embodiment, a biased fabric is supplied. The biased fabric supply has a first specified width and a first bias angle of warp yarns relative to weft yarns. At least one overfeed roller configured to overfeed fabric from the biased fabric supply at an overfeed rate is provided. At least one spreading arm configured to stretch the fabric to a second specified width and a fabric oven configured to heat the biased fabric supply to a specified temperature and output a balanced crimp and/or elongation biased fabric are also provided.

10 Claims, 4 Drawing Sheets

SYSTEMS AND METHODS FOR FABRICATING BIASED FABRIC

TECHNICAL FIELD

The present disclosure is generally related to the manufacture of fabrics; and, more specifically, to the manufacture of biased fabric.

BACKGROUND

Rubber or other elastomeric belts can be reinforced with fabric, including fabric having thermoplastic fibers. As noted in U.S. Pat. No. 5,068,000 to Lauderdale ("Lauderdale"), which is incorporated herein by reference in its entirety, such reinforcing fabric can be incorporated into or upon elastomeric materials of a belt to improve the stability of the belt. Warp and weft yarns of reinforcing fabric incorporated into a belt can be oriented at an angle such as sixty degrees relative to the longitudinal direction of axis of a belt. Therefore, biased fabric can be employed for such an application.

Fibers or yarns of such biased fabric that are oriented in the warp direction may posses a different elongation and/or crimp relative to fibers or yarns oriented in the weft direction. The varying degree of elongation and/or crimp can be a result of prior art systems and methods employed in fabricating biased fabric for the purposes of reinforcement of elastomeric belts.

SUMMARY

In one embodiment, a method is disclosed. The method includes receiving a woven fabric of a first specified width. The fabric is composed of yarns oriented in a warp direction and a weft direction at a first specified angle relative to one another. The method also includes overfeeding the fabric at an overfeed rate and extracting the fabric at a first feed rate. The overfeed rate exceeds the first feed rate. Finally, the method includes stretching the fabric to a second specified width and heating the stretched fabric to a specified temperature to cause the woven fabric to have a second angle of warp yarns relative to weft yarns.

In another embodiment, a system is disclosed. The system includes an input roller configured to provide a biased fabric supply. The biased fabric supply has a first specified width and a first bias angle of warp yarns relative to weft yarns. The system includes at least one overfeed roller configured to overfeed fabric from the biased fabric supply at an overfeed rate. The system also includes an extraction roller configured to extract the fabric at a specified feed rate, wherein the overfeed rate exceeds the specified feed rate. The system finally includes at least one spreading arm configured to stretch the fabric to a second specified width, and a fabric oven configured to heat the biased fabric supply to a specified temperature and output a balanced biased fabric.

Other systems, methods, features, and advantages of this disclosure will be or become apparent to one with skill in the art upon examination of the following drawings and detailed description. It is intended that all such additional systems, methods, features, and advantages be included within this description and be within the scope of the present disclosure.

BRIEF DESCRIPTION

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views. While several embodiments are described in connection with these drawings, there is no intent to limit the disclosure to the embodiment or embodiments disclosed herein. On the contrary, the intent is to cover all alternatives, modifications, and equivalents.

DETAILED DESCRIPTION

Figure 1:
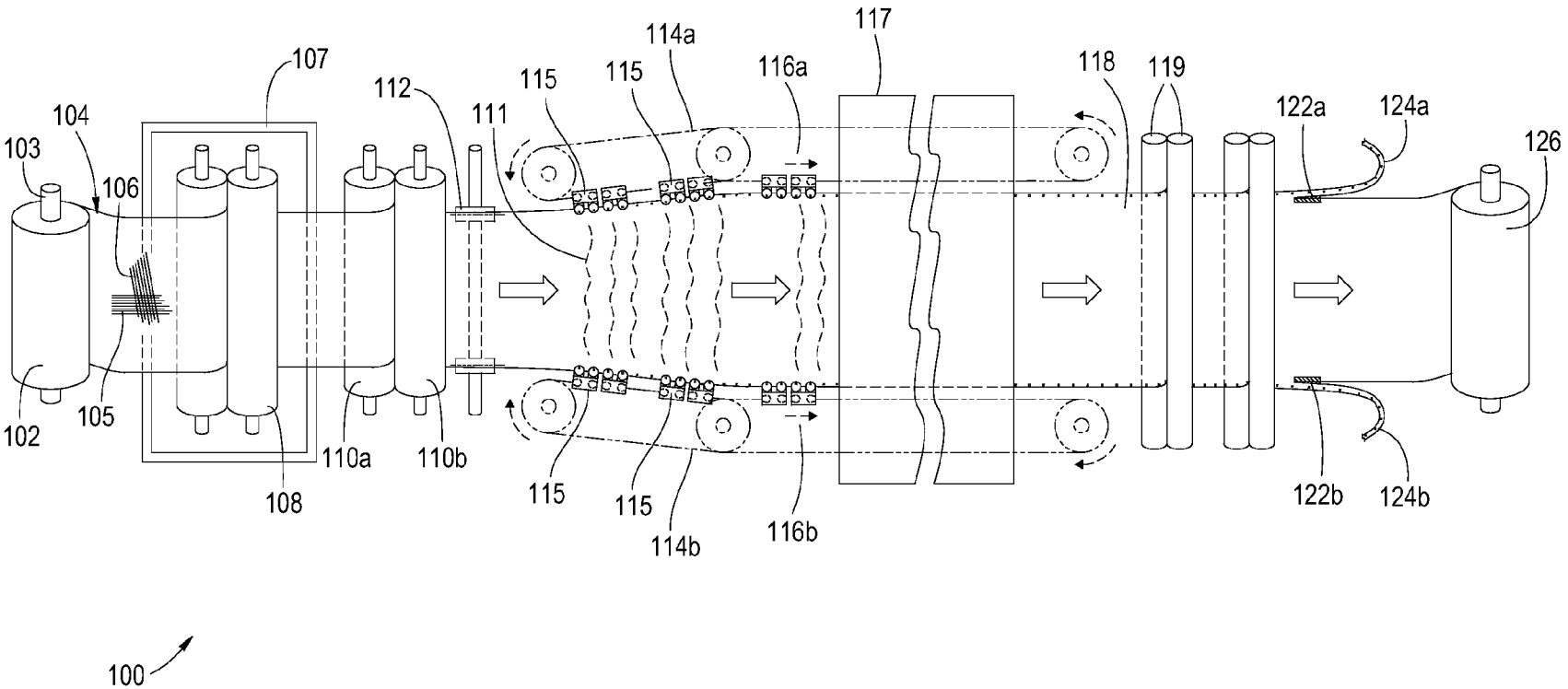
FIG. 1 depicts a top plan view of an embodiment of the disclosure configured to post process a biased fabric supply into a balanced biased fabric.

As disclosed above, biased fabric employed to reinforce elastomeric belts can possess warp yarns having crimp and/or elongation differing from the weft yarns of the fabric. The present disclosure provides systems and/or methods for the post-processing of biased fabric such that it is produced with warp and weft yarns with substantially similar elongation and/or crimp. Such biased fabric employed to reinforce an elastomeric belt can be preferred relative to biased fabric produced by prior art systems and methods, as biased reinforcing fabric having warp and/or weft yarns of substantially similar elongation and/or crimp can offer better performance and durability, particularly when such fabric is employed in elastomeric belts that may undergo press curing, step curing, and/or other curing processes during manufacture.

As a non-limiting example, biased reinforcing fabric having warp and weft yarns of unequal crimp and/or elongation can torque or cause an elastomeric belt to twist during the curing process. Additionally, this twisting can cause rotation of the cord line inside an elastomeric belt, which can yield a belt that may disintegrate or be otherwise compromised. Such behavior occurs because during curing of an elastomeric belt due to warp yarns and weft yarns having varying crimp and/or elongation relative to each other. As a result, warp and weft yarns may expand, contract, or respond differently to stresses, temperature changes, or other environmental inputs. Known systems and methods can be employed to manufacture biased fabric having a desired bias angle according to the teachings of the above disclosed Lauderdale patent. While the systems and methods depicted therein may cause a desired bias angle to be imparted onto a particular fabric, the crimp and/or elongation of warp and weft yarns incorporated into such biased fabric can be unequal.

Although the term "plurality," "yarns," or "fibers" as used herein with respect to fibers, warp yarns, and/or weft yarns refer to "multiple" and/or "several," the term "plurality" as used in this document also refers to the phrase "more than one" (e.g., can mean "two"). As used herein, the term "warp yarns" refers to lengthwise threads or yarns of a fabric, or, in other words, yarns of a fabric oriented in the "machine direction," or longitudinal direction. In the context of a biased fabric, "warp yarns" refers to such threads or fibers prior to biasing of the fabric. Biased fabric can be manufactured such that weft yarns can be oriented at a specified angle relative to the longitudinal axis of a biased fabric. As used herein, the term "weft yarns" refers to threads or yarns that are woven, attached or inserted across warp yarns in order to create a fabric. In other words, weft yarns of a fabric can be oriented substantially perpendicular to the longitudinal direction, or "machine direction" of a fabric. Similarly, in the context of a biased fabric, "weft yarns" refers to such threads or yarns prior to biasing of the fabric. Biased fabric can be manufactured such that weft yarns can be oriented at a specified angle relative to the longitudinal axis of a biased fabric.

Reference is now made to FIG. 1, which depicts a top plan view of one embodiment 100 of a system configured to cause the crimp and/or elongation of warp and weft yarns of a biased fabric supply to be substantially similar. The embodiment 100 is configured to "post-process" a biased fabric supply 102 provided to an input roller 103 by causing the elongation and/or crimp of the warp and weft yarns of the biased fabric supply 102 to be substantially similar. The provided biased fabric supply 102 can be produced with and/or according to known systems and methods with an imparted bias angle between the warp and weft yarns. As the biased fabric supply 102 is produced according to systems and/or methods known in the art, it includes a fabric having crimp and/or elongation of warp yarns substantially differing from those of the weft yarns therein. Therefore, if such fabric is employed as a reinforcing fabric in an elastomeric belt, it may be susceptible, as noted above, to twisting or other becoming otherwise compromised, particularly during curing of the elastomeric belt.

Accordingly, the depicted embodiment is configured to receive a biased fabric supply 102 of a specified width and a specified angle of weft yarns relative to warp yarns, and output a balanced biased fabric of a second width and a second angle of weft yarns relative to warp yarns. Additionally, the balanced biased fabric that is produced by such "post-processing" line of an embodiment of the disclosure possesses warp yarns and weft yarns having substantially similar crimp and/or elongation.

The biased fabric supply 102 can include various fabrics composed of various yarns, fibers, and/or materials. As a non-limiting example, the biased fabric supply 102 can comprise nylon, polyester, acrylic, aramid, and olefin fibers or other thermoplastic fibers and/or synthetic fibers. Additionally, the biased fabric supply 102 can include natural fibers and/or yarns including but not limited to cotton, and wool. As yet another non-limiting example, the biased fabric supply 102 can be composed of a combination of various thermoplastic fibers, synthetic fibers, and/or natural fibers.

Therefore, with reference to the depicted embodiment 100, the fabric 104 of a specified width is extracted from the biased fabric supply 102. Fabric 104 is depicted with a non-limiting exemplary bias angle between the warp yarns 105 and weft yarns 106; however, the bias angle of the fabric 104 supplied by the biased fabric supply 102 can be varied according to the bias angle required in the balanced biased fabric, or other requirements and/or variables. For example, biased fabric for reinforcing an elastomeric belt can be chosen having various angles of weft yarns relative to warp yarns according to various factors, which can include but are not limited to: the gauge of the belt, belt density, weight, length, belt application, and/or the degree or nature of forces that may be applied to the belt in usage, as well as other factors.

The fabric 104 supplied by the biased fabric supply 102 by the input roller 103 may be subsequently submerged in fluid tank 107, which saturates the fabric 104 with a fluid which facilitates manipulation of the fibers composing the fabric. The fabric 104 may also be passed through a steam chamber or other system or method for imparting a fluid into the fabric. Or, alternatively, the fluid saturation of any kind may be bypassed altogether. Saturation rollers 108 facilitate submersion of the fabric 104 in the fluid tank 107 by receiving the fabric 104 from the input roller 103 and directing the fabric 104 into the tank. Submersion of the fabric 104 in a fluid in fluid tank 107 facilitates manipulation and/or movement of warp yarns relative to weft yarns, which can in turn facilitate altering the elongation and/or crimp of the warp yarns 105 relative to the weft yarns 106 such that they are substantially similar. The fluid in the fluid tank 107 for submersion of the fabric 104 in the fluid tank can be at least one chosen from: water, solvent solutions of dyes, adhesives, resins and latex, and other fluids.

Upon saturation of the fabric 104 in the fluid tank 107, the fabric 104 is directed by the saturation rollers 108 to at least one overfeed roller 110. The depicted overfeed roller 110 is configured to overfeed the fabric 104 at a specified overfeed rate. As a non-limiting example, the specified overfeed rate can be a rate that is ten percent greater than the rate of the spreading arms 114 (depicted in parts 114*a* and 114*b* ) and tenterframe 116 (depicted in parts 116*a* and 116*b* ). Various overfeed rates can be chosen so long as the overfeed rate is greater than the rate at which the spreading arms 114 and/or tenter frame 116 are configured to facilitate movement of the fabric 104 through the embodiment 100. Overfeeding the fabric 104 as depicted in the embodiment 100 can also cause bunching or fabric waves 111 to develop in the fabric as it is output from the overfeed roller 110 and onto the spreading arms 114.

The fabric waves 111 that may appear as the fabric 104 moves through the embodiment 100 are generated because the overfeed roller 110 causes fabric to enter the remainder of the line at a rate greater than the rate at which spreading arms 114 and tenter frame 116 are configured to facilitate movement of fabric through the depicted embodiment 100.

Accordingly, a pin-on apparatus 112 or pin apparatus is positioned on each selvedge at or near the output of the overfeed rollers 110*a* and 110*b* to facilitate continued movement of the fabric 104 through the embodiment 100 and to force the fabric 114 onto pin plates 115 of the spreading arms 114 and tenter frame 116. The pin-on apparatus 112 can be configured to receive and output the fabric 104 at a rate substantially similar to the overfeed rate. The pin-on apparatus 112 is also configured to substantially ensure the fabric 104 continues through the depicted embodiment 100 and onto the pin plates 115 rather than uncontrollably bunching. Additionally, while the depicted pin-on apparatus 112 is illustrated as a plurality or series of pins on a roller or wheel, an alternative apparatus can be employed to facilitate movement of the fabric 104 through the post processing line of the depicted embodiment 100. As a non-limiting example, a series of nip rollers, air jets, brushes and or other apparatus configured to move the fabric 104 through the embodiment 100 can also be employed.

The fabric 104 is output from the pin-on apparatus 102 to spreading arms 114, which stretch the fabric 104 in a direction substantially perpendicular to the direction of the warp yarns or longitudinal axis of the fabric 104. In other words, the spreading arms 114 stretch the fabric in a direction substantially perpendicular to the machine direction of the depicted embodiment 100. As noted above, because the fabric is input to the spreading arms 114 at an overfeed rate exceeding the specified rate of the spreading arms 114 and tenter frame 116, the fabric 104 may exhibit bunching or fabric waves 111. Accordingly, because the overfeeding of the fabric 104 causes fabric waves 111 due to more fabric in a given linear distance of the tenter frame 116 relative to the line prior to overfeeding, the perpendicular stretching of the fabric operates to increase the width of the fabric as well as to begin to remove fabric waves 111. Additionally, the stretching of the fabric 104 by the spreading arms 114 also shifts the relative angle of weft yarns to warp yarns of the fabric 104.

Accordingly, the bias angle and the width of balanced biased fabric output by the depicted embodiment 100 may differ from the biased fabric supply 102 that is input into the embodiment by the input roller 103. As a non-limiting example, if the biased fabric supply 102 includes fifty-nine inches-wide fabric having thermoplastic nylon fibers with warp and weft yarns oriented at a 113 degree relative angle and an overfeed rate of ten percent in excess of a feed rate of the spreading arms 114 and tenter frame 116, balanced biased fabric output by the embodiment may include a fabric having an approximate sixty-three inches width and warp and weft yarns oriented at a 105 degree relative angle. In other words, the embodiment may shift the bias angle and increase the width of the fabric 104 by approximately five to ten percent or more. However, due to the saturation, overfeeding, and stretching of the fabric 104 caused by the embodiment 100, the yarn crimp or elongation of the warp and weft yarns of the balanced biased fabric output by the embodiment 100 are substantially similar as opposed to the inconsistency between the warp and weft yarns of the biased fabric supply 102.

The spreading arms 114 are depicted as implemented with a tenterframe configured to secure the fabric 104 by the selvedge or edges and facilitate movement of the fabric 104 through the embodiment 100. This is but one non-limiting example, and that the spreading arms 114 can be implemented in various ways, including, but not limited to a series of pins, pin plates, or other apparatuses, systems, or methods for facilitating movement of and/or stretching the fabric 104. In the depicted embodiment 100 while at least one tenterframe pin plate 115 is depicted, all such pin plates that may be used to facilitate movement of the fabric 104 may not be illustrated in the drawing for ease of depiction. Pin plates 115 may also cut or cause holes in the fabric 104 at or near the selvedge or edge of the fabric 104 as the overfeed roller 110 outputs fabric into the pin-on apparatus 112 and into the spreading arms 114. Such holes can be caused because pin plates 115 may employ pins to secure the fabric to the spreading arms 114 and tenterframe 115.

Upon stretching of the fabric 104 by the spreading arms 114, the fabric is further moved through the embodiment 100 by the tenter frame 116. As noted above in reference to the spreading arms 114, the tenter frame 116 can also be implemented with any system, method or device configured to facilitate movement of the fabric 104 through the embodiment 100. The depicted tenter frame 116 facilitates movement of the fabric 104 through the fabric oven 117, which is configured to dry, cure, and/or heat set the fabric 104. The fabric oven 117 can assist in flattening the fabric waves 111 exhibited following overfeeding of the fabric by the overfeed roller 110. Additionally, the heating process caused by the fabric oven 117 also dries excess fluid in the fabric 104 that it may be carrying due to the saturation in the fluid tank 107. Further, with respect to a fabric 104 composed of thermoplastic fibers such as nylon, the fabric oven 117 may also impart a fabric memory into the fabric 104, which can cause the fabric 104 to retain crimp and/or elongation imposed by the embodiment 100. As one non-limiting example, the fabric oven 117 can heat the fabric to approximately 420 degrees Fahrenheit or more.

The balanced biased fabric 118 emerging from the fabric oven 117 is substantially without fabric waves, bunching or other similar imperfections caused by the overfeed roller 110; however, the elongation and/or crimp of warp yarns relative to weft yarns is substantially similar. Further, as noted above, the relative angle of warp yarns to weft yarns has been altered due to the saturation, overfeeding, stretching, and heating conducted on the post-processing line of the embodiment 100. In other words, the relative position of warp yarns to weft yarns shifts during the post-processing line; therefore, the relative angle shifts as well. Accordingly, to reach a desired bias angle in a balanced biased fabric 118, an appropriate biased fabric supply 112 having a width and bias angle should be chosen.

The balanced biased fabric 118 is then removed from the tenter frame 116 pin plates 115 at the oven output roller 119 and directed to hot knives 122 or fabric edge trimmers, which can remove the selvedge 124 from the balanced biased fabric 118. Removal of selvedge from the balanced biased fabric 118 can be accomplished with various alternative systems and methods, which can include, but are not limited to: ultrasonic slitter, a laser cutter system, or other systems and/or methods. In addition, removing selvedge 124 from the balanced biased fabric 118 may not be necessary and in some elastomeric belt reinforcement applications, selvedge removal may be bypassed altogether. A finished balanced biased fabric 126 is thusly generated upon the optional removal of selvedge 124 from the balanced biased fabric 118.

Figure 2:
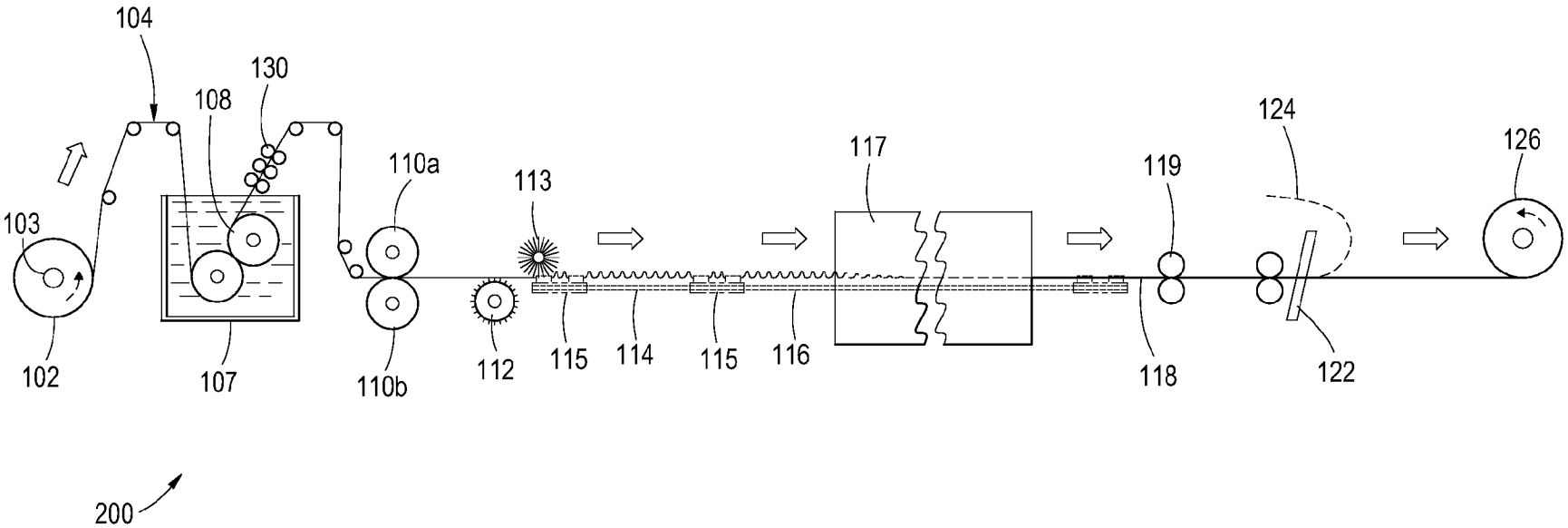
FIG. 2 depicts an alternative embodiment of the disclosure.

Reference is now made to FIG. 2, which illustrates an alternative embodiment 200 of the disclosure. The input roller 103 provides fabric 104 from the biased fabric supply 102 to the fluid tank 107. The fluid tank 107 may contain a liquid configured to saturate the fabric in order to facilitate movement and/or shifting of warp yarns of the fabric 104 relative to its weft yarns. Saturation rollers 108 facilitate movement of the fabric 104 through the fluid tank 107. Additionally, upon submersion in the fluid tank 107, the depicted nip rollers 130 can be configured to remove excess fluid from the fabric 104. Excess fluid from the fabric 104 can be removed subsequent to saturation in order to facilitate consistent adjustment of the elongation and/or crimp of the warp yarns relative to the weft yarns by the post processing line of the embodiment 100.

Upon removal of excess fluid from the fabric 104, the nip rollers 130 can facilitate movement of the fabric 104 to at least one overfeed roller 110. As noted above, the overfeed roller 110 is configured to facilitate movement of the fabric through the embodiment 100 at a rate that exceeds the rate at which other rollers and systems subsequent to the overfeed roller 110 such as spreading arms 114 and tenter frame 116 are configured to move the fabric 104. As a non-limiting example, the depicted overfeed rollers 110 can be configured to facilitate movement of the fabric 104 at a rate that exceeds the rate of the spreading arms 114 and/or tenter frame 116 of the embodiment 100 by ten percent. As depicted in FIG. 2, because overfeed rate of the overfeed roller 110 exceeds the rate of spreading arms 114 and tenterframe 116, bunching or fabric waves can be caused. Accordingly, the depicted pin-on apparatus 112 and pin plates 115 are configured to facilitate movement of the fabric 104 through the post processing line of the embodiment 200 despite the bunching caused by the overfeed roller 110.

In addition, brush wheels 113 can further assist facilitating movement of the fabric through the embodiment 100 by forcing the fabric 104 onto the pin plates 115 of the spreading arms 114 and/or tenter frame 116, thereby ensuring that the fabric 104 continues down the line. In addition, FIG. 2 depicts the bunching that is alleviated by the stretching of the fabric 104 as well as the heating of the fabric in the fabric oven 117. Additionally, as noted above, the stretching and heating processes shift warp yarns of the fabric 104 relative to weft yarns to cause the elongation and/or crimp to be substantially similar; or altered per the a customer's needs. Accordingly, balanced biased fabric 118 is output, which can be trimmed of selvedge 124 by hot knives 122. Therefore, a finished balanced biased fabric 126 is produced by the embodiment 200.

Figure 3:
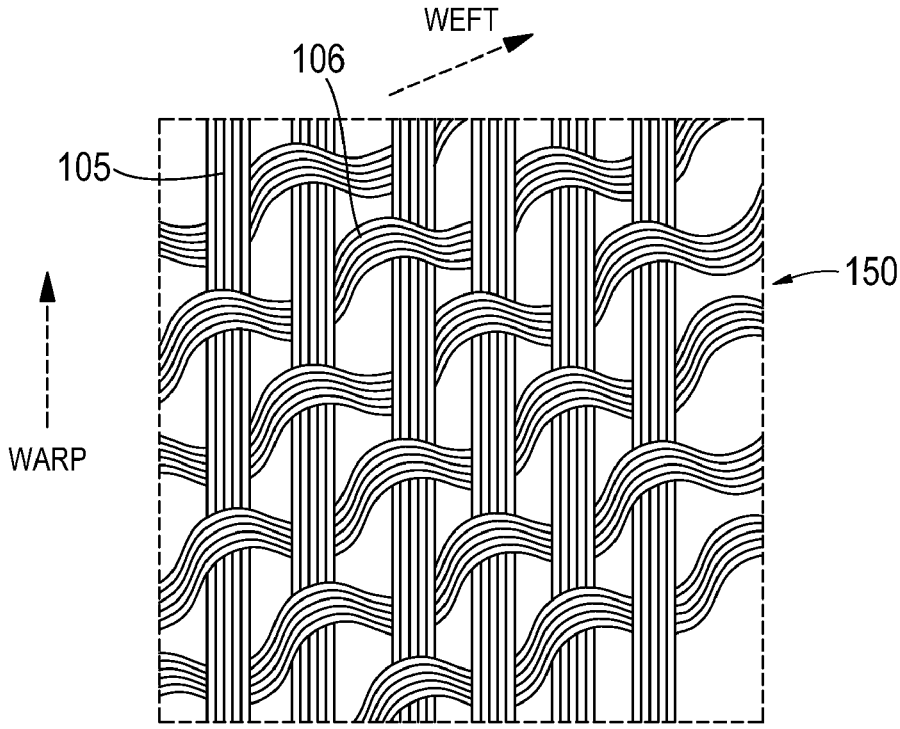
FIG. 3 depicts a non-limiting example of a biased fabric supply having warp yarns and weft yarns of unequal crimp and/or elongation.
Figure 4:
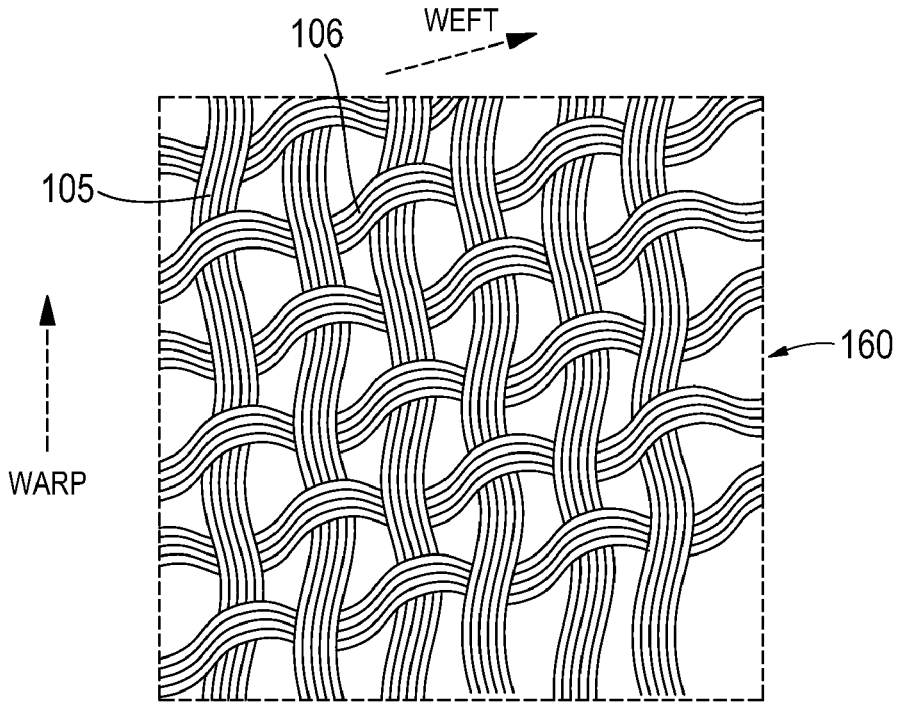
FIG. 4 depicts a non-limiting example of a balanced biased fabric supply having been post processed by an embodiment of the disclosure such that it has substantially similar crimp of warp yarns relative to weft yarns.

FIG. 3 depicts a non-limiting example of a biased fabric supply 150 provided to an embodiment of the disclosure. The warp yarns 105 of the depicted fabric exhibit an elongation, and/or crimp that varies relative to the depicted warp yarns 106. Accordingly, FIG. 4 depicts a non-limiting example of a balanced biased fabric 160 processed by an embodiment of the disclosure. The depicted warp yarns 105 exhibit a crimp and/or elongation that is substantially similar to the depicted weft yarns 106.

Figure 5:
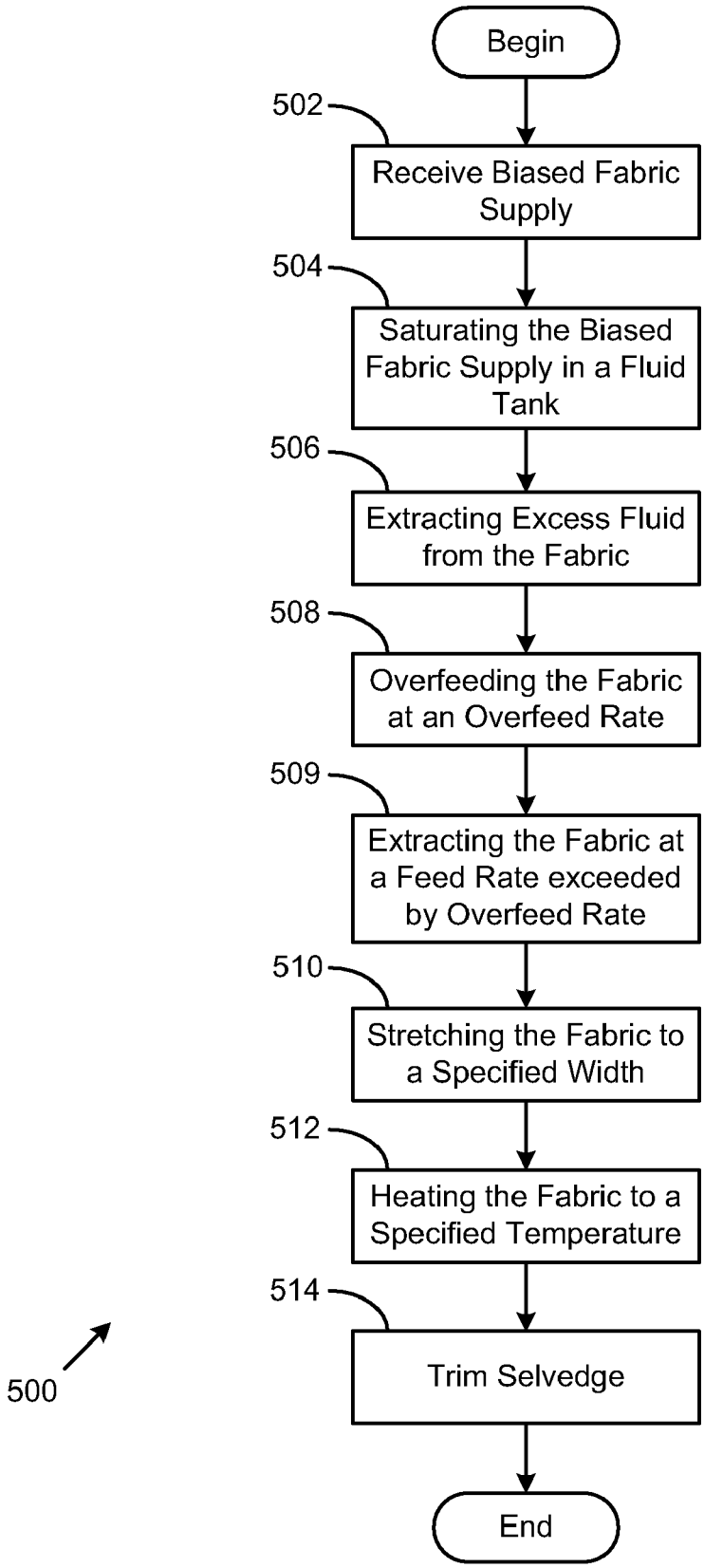
FIG. 5 depicts a flowchart of one example of a method according to the disclosure.

Reference is now made to FIG. 5, which depicts a flowchart illustrating one example of a method according to the present disclosure. In step 502, a biased fabric supply is provided. As noted above, a biased fabric supply can include fabric having a bias angle greater than 90 degrees of weft yarns relative to warp yarns. A biased fabric supply manufactured according to prior art systems and methods can possess inconsistencies in the elongation and/or crimp of weft yarns relative to warp yarns. Accordingly, the depicted method can post-process a biased fabric supply to cause warp yarns and weft yarns to have substantially similar elongation and/or crimp. As also noted above, such biased fabric can be used for reinforcement of elastomeric belts, which can include, but are not limited to, a rubber belt.

In step 504, the provided biased fabric supply is saturated in a fluid tank. The fluid tank can contain water, or any other liquid that can aid in the movement of weft yarns relative to warp yarns as well as improve the ability to otherwise manipulate the provided fabric. Step 504 may be bypassed or the biased fabric supply may be instead passed through a steam chamber or other system or method for introducing a fluid into the fabric to facilitate manipulation of the fibers or yarns therein. In step 506, excess liquid can be extracted from the provided biased fabric supply. In step 508, the fabric is overfed at a specified overfeed rate. As noted above, the overfeed rate can be chosen at a rate which causes bunching or waves in the fabric to form as it moves through an assembly line or post processing line. As a non-limiting example, an overfeed rate that exceeds the rate systems receiving the overfed fabric by about ten percent can be chosen.

In step 509, the fabric is extracted at a feed rate exceeded by the overfeed rate. As a non-limiting example, the overfeed rate can exceed the feed rate by about ten percent. In step 510, the fabric is stretched in a direction substantially perpendicular to warp yarns of the fabric in order to cause shifting of warp yarns relative to weft yarns. As noted above, shifting of warp yarns relative to weft yarns can change the elongation and/or crimp of warp yarns relative to weft yarns as well as the bias angle. In step 512, the stretched fabric is heated in a fabric oven or other similar device configured to cure the fabric and produce a balanced biased fabric having substantially consistent tension of weft yarns relative to warp yarns. In step 514, selvedge can be trimmed from the balanced biased fabric to produce a finished balance biased fabric.

Although the flow chart of FIG. 5 shows a specific order of execution, it is understood that the order of execution may differ from that which is depicted. For example, the order of execution of two or more blocks may be scrambled relative to the order shown. Also, two or more blocks shown in succession in FIG. 5 may be executed concurrently or with partial concurrence. In addition, any number of electronic or computer systems, counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

All temperatures, widths, and other parameters expressed herein are merely exemplary. It is to be understood that such examples are expressed herein for convenience and brevity, and thus, should be interpreted in a flexible manner to include not only the parameters explicitly recited, but also to include parameters that are substantially similar. The above described embodiments can be configured to receive biased fabrics having various bias angles while causing the crimp and/or elongation of warp and weft yarns of the biased fabric to become substantially similar. Further, the above described systems of the embodiment, such as, but not limited to, the spreading arm, overfeed roller, fabric oven, fluid tank, and input rollers can be configured in various ways consistent with this disclosure.

As a non-limiting example, an overfeed rate and spreading arm varying from any above expressed overfeed rates can be chosen to accomplish the above noted task of the manufacture a balanced biased fabric. Similarly, spreading arms configured to stretch a fabric to widths other than any above expressed widths can be chosen to likewise accomplish the same. In addition, any above described depictions of systems and/or methods of the disclosure can be varied consistent with this disclosure. In other words, any rollers, pin-on apparatus, or other systems depicted and/or disclosed above are merely exemplary, and are not intended to limit the scope of embodiments of the disclosure. Accordingly, the above-described embodiments of the present disclosure, particularly any "preferred" embodiments, are merely possible examples of implementations, and are merely set forth for a clear understanding of the principles of the disclosure. Many variations and modifications can be made to the above-described embodiment(s) without departing substantially from the principles of the disclosure. All such modifications and variations are intended to be included herein within the scope of this disclosure and protected by the following claims.

One should also note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments.

The invention is claimed is:

1. A method of processing a fabric supply to yield substantially similar crimp of warp yarns relative to weft yarns of the fabric supply, comprising the steps of:

receiving a fabric of a first specified width, the fabric comprising yarns oriented in a warp direction and a weft direction at a first specified angle relative to one another, the fabric further comprising a biased fabric supply;

saturating the received fabric in a fluid;

extracting excess fluid from the saturated fabric;

overfeeding the fabric at an overfeed rate;

receiving the overfed fabric at a specified feed rate, the overfeed rate exceeding the specified feed rate;

stretching the received fabric in a direction substantially perpendicular to a machine direction to a second specified width; and heating the stretched fabric to a specified temperature.

2. The method of claim 1, further comprising the step of trimming a third specified width from at least one edge of the heated fabric.

3. The method of claim 2, wherein the third specified width is the width of at least one selvedge of the fabric.

4. The method of claim 1, wherein the overfeed rate exceeds the specified feed rate by about ten percent.

5. The method of claim 1, wherein the second specified width exceeds the first specified width by about five percent to ten percent.

6. The method of claim 1, wherein the fabric comprises woven thermoplastic fibers.

7. The method of claim 6, wherein the thermoplastic fibers are at least one chosen from: nylon, polyester, acrylic, aramid, and olefin.

8. The method of claim 6, wherein the specified temperature is configured to cure the thermoplastic fibers.

9. The method of claim 8, wherein the specified temperature is configured to dry the fluid, cure, and heat set the thermoplastic fibers to impart a memory on the thermoplastic fibers.

10. The method of claim 1, wherein the fabric is a bias shifted fabric and the first specified angle is greater than about 90 degrees.

* * * * *